United States Patent [19]

Fern

[11] Patent Number: 4,735,450

[45] Date of Patent: Apr. 5, 1988

[54] LIFTING GEAR AND TESTING IT

[75] Inventor: Derek T. Fern, Watford, Great Britain

[73] Assignee: PMB Systems Engineering, Limited, London, Great Britain

[21] Appl. No.: 928,625

[22] Filed: Nov. 3, 1986

Related U.S. Application Data

[63] Continuation of Ser. No. 767,000, Aug. 19, 1985, abandoned.

[30] Foreign Application Priority Data

Jul. 8, 1985 [EP] European Pat. Off. ..... 85304847

[51] Int. Cl.[4] ..... B66C 1/12

[52] U.S. Cl. ..... 294/89; 73/831; 294/81.53

[58] Field of Search ..... 294/89, 81.53; 73/432.1, 158, 826, 831

[56] References Cited

U.S. PATENT DOCUMENTS

| | | | |
|---|---|---|---|
| 2,748,646 | 6/1956 | Harold et al. | 294/89 |
| 3,137,051 | 6/1964 | Bethea | 24/123 |
| 3,342,067 | 9/1967 | Bush | 73/831 |
| 3,626,508 | 12/1971 | Sharrow | 294/89 |
| 4,074,519 | 2/1978 | Garrett | 294/89 |
| 4,374,473 | 2/1983 | Brockman | 73/158 |
| 4,478,086 | 10/1984 | Gram | 73/826 |

FOREIGN PATENT DOCUMENTS

| | | | |
|---|---|---|---|
| 124194 | 5/1947 | Australia | 294/89 |
| 1513878 | 3/1967 | France | 294/89 |
| 1219568 | 1/1967 | United Kingdom . | |
| 2040872 | 1/1979 | United Kingdom . | |

*Primary Examiner*—Stewart J. Levy
*Assistant Examiner*—Robert R. Raevis
*Attorney, Agent, or Firm*—Townsend & Townsend

[57] ABSTRACT

A lifting attachment for lifting a heavy load comprises a generally cylindrical member (7,30) which may be a post passing through a hole in the load, or a sleeve fitting over a post (6) fixed to the load. To retain a lifting sling, the member (7,30) has a radially projecting retaining flange (8), that extends circumferentially at least partly around it; the flange (8) has a curved shaped with wings (12) curving upwardly from its lowermost portion, so that an increasing amount of the flange (8) contacts the sling as the angle of approach of the sling to the sleeve becomes more acute. The flange (8) and member (7,30) may be a re-usable one-piece casting. Apparatus is also provided for test-loading the lifting attachment.

16 Claims, 4 Drawing Sheets

LIFTING GEAR AND TESTING IT

This is a continuation of application Ser. No. 767,000, filed Aug. 18, 1985, now abandoned.

This invention relates to attachments used for lifting very heavy loads. More specifically it is concerned with the transfer of load from a lifting sling to a very heavy object, and to the testing of the capacity of that transfer means. The invention finds particular application in offshore oil installations where so-called "modules" are floated out by barge to the bare platforms which have been previously positioned and are then lifted from the barge to a predetermined place on the platform.

Current offshore crane capacities allow large modules of 2–3,000 tons to be installed. The modules are extremely large and extremely heavy and might be made heavier. Restrictions on this are imposed amongst other things by the state of the technology of the lifting gear.

Because of the limitations of conventional shackles and ropes, the industry has developed lifting attachments which incorporate horizontally running trunnions or welded rings, which are called pad ears. However these are always individually designed having regard to weight and size of the load to be lifted and the center of gravity of that load, and have not been re-usable. They are used once, cut off and then scrapped. Four of these attachments, typical for one module, may cost at present prices more than 200,000.

The object of the present invention is to provide a universal and a re-usable lifting attachment for very heavy loads. It is envisaged that loads of five or even seven thousand tons may be able to be handled with such attachments, which because of their reusability justify the expenditure on them of proper engineering effort such that they become efficient and reliable.

Consequently we also provide in this invention a test rig for testing the lifting attachment in a reliable and reproducible manner. With conventional pad ears it is impossible to proof test in a reliable manner mainly because of their single use nature and their heavy reliance on the nature and efficiency of the welded attachment to the module.

According to the invention we provide a lifting attachment for a heavy load, comprising a generally cylindrical member to be aligned with its axis substantially parallel with the lifting direction. The cylindrical member has a radially projecting retaining flange that extends circumferentially at least partly around the cylindrical member, and has side parts curving upwardly toward the lifting direction from a central lower part.

In a first form of the invention the cylindrical member is a sleeve to be fitted over a post having a cylindrical outer surface and which is intended to be massively and permanently secured to the object to be lifted in such a manner that its central axis is vertical in use. The sleeve surrounds part of the post so as to be rotable about its axis. The sleeve may be a unitary casting and includes a flange for guiding a sling and transmitting lifting load between a stop and the sleeve which flange is curved when projected onto a plane containing the axis of the post, whereby an increasing amount of the flange is in contact with the sling as the angle of approach of the sling to the sleeve becomes more acute, and a stop on the post to restrict axial movement of the sleeve along the post.

The sleeve is re-usable since it may be liberated from the post even when the latter is massively welded to the module. This may be done by cutting the post, e.g. between the sleeve and the module, the upper end of the post then being discarded probably with the stop still on it, or by cutting off the ring, or by making the stop removably mechanically connected with the post so that in either case it may be removed and the sleeve be taken off the end of the post leaving the entire post in situ in the module. In these latter alternatives, the upper end of the post may be used as a stabbing cone for locating a next uppermost module.

The sleeve is as mentioned a massive one-piece steel casting. Its inner surface has at least portions closely matching the cylinder of the outside surface of the post. The curved flange which transmits lifting load from the sling to the sleeve may be of minimum radial width at its lowest point and increases in its radial width towards its upper point. Below the flange the diameter of the surface of the sleeve may be somewhat increased as it approaches its lowest point whereby the thickness of the material of the sleeve is increased below the flange, and may be shaped to form a bed for an essentially cylindrical cable laid sling. Above the flange, a tapered thickening in the wall of the sleeve is provided to buttress the flange from above i.e. in the direction opposite that in which the flange will receive lifting strain.

The curvilinear shape of the flange as seen in developed view looking towards the axis of the sleeve is preferably the arc of a circle which is horizontal at its lower point, the center of curvature of the circle preferably lying beyond the line of the outer wall of the sleeve.

The sleeve may further have a lower flange which is to assist the sling in being guided into its engagement with the upper flange. It also provides an external stiffening for the sleeve to prevent it from being squeezed out of the circular (a function which is also partially performed by the upper flange).

A preferred stop for the sleeve is a cylindrical metallic ring and this is preferably welded around its upper circumference to the post. Alternatively a temporary mechanical engagement may be used such as for example a split retaining ring housed in a groove in the post and releasably retained by a clamp.

The post is preferably a tubular member because in the present embodiment in which the stop is welded to the post, the sleeve is removed for re-use by cutting through the tube below the sleeve once the lifting has been completed. In a second form of the invention the cylindrical member passes through a hole in the structure of the load. Its outer surface has at least portions closely matching the inside of the hole. In this form the cylindrical member itself is fitted with a stop where it projects below the hole in the structure, so that the stop transmits lifting load between the cylindrical member and the load. When the cylindrical member has a lower, guiding flange this may serve to keep the cylindrical member from falling into the hole when not under load.

The mechanical stop is preferably a shear ring bolted to the cylindrical member. Removal of the shear ring after use allows the lifting attachment to be lifted out of the hole for re-use.

A preferred feature is the use of a hollow tubular cylindrical member, which may then be filled with a filler to improve stress distribution.

The test gear for the assembly includes a base and a head held immobile relative to each other. Both the base and the head are massive and on the base is mounted, at a predetermined angle to the direction between the head and base, a post and sleeve of the assembly. In the head of the test gear jacks are provided to pull on opposite ends of the cable which has been passed round the sleeve in the manner of a sling. In this way an ascertained load equal to or exceeding the design load may be applied routinely and reproducively to each sleeve which is to be sent out for use; and if desired each sleeve and post assembly may be tested in this way. In that the preferred maximum angle for the sling to the horizontal in actual use will be 60°, an angle of 30° for the setting of the post to the vertical in the test gear will give the equal angle between the test cable and the sleeve.

Specific embodiments of the invention will now be described by reference to the accompanying drawings wherein.

Figure 1:
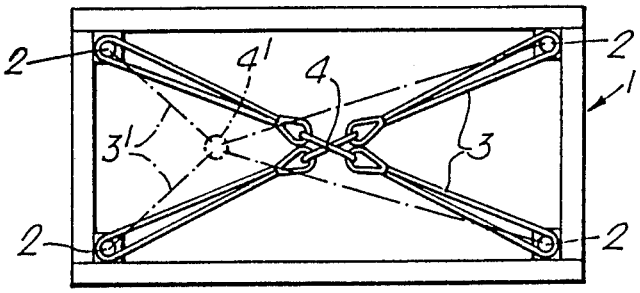
FIG. 1 is a plan view of a module with four slings attached to it ready for lifting.

In FIG. 1 a module 1 is shown which has near each of its upper corners a lifting attachment 2 embodying the invention. Cable laid slings 3 pass round each of these to a central hook assembly 4 on the crane. The slings are shown of equal length but they need not be. The center of gravity of the module will sometimes not be in its geometrical center and then the slings will be of different lengths as is indicated for example by dotted lines 3'. When the actual center of gravity does not coincide with the load's geometrical center, the slings must extend from the various corners in an asymmetrical fashion.

The present invention allows for the accommodation of either situation in an attachment which is however also capable of use on modules where other geometries are needed.

Figure 2:
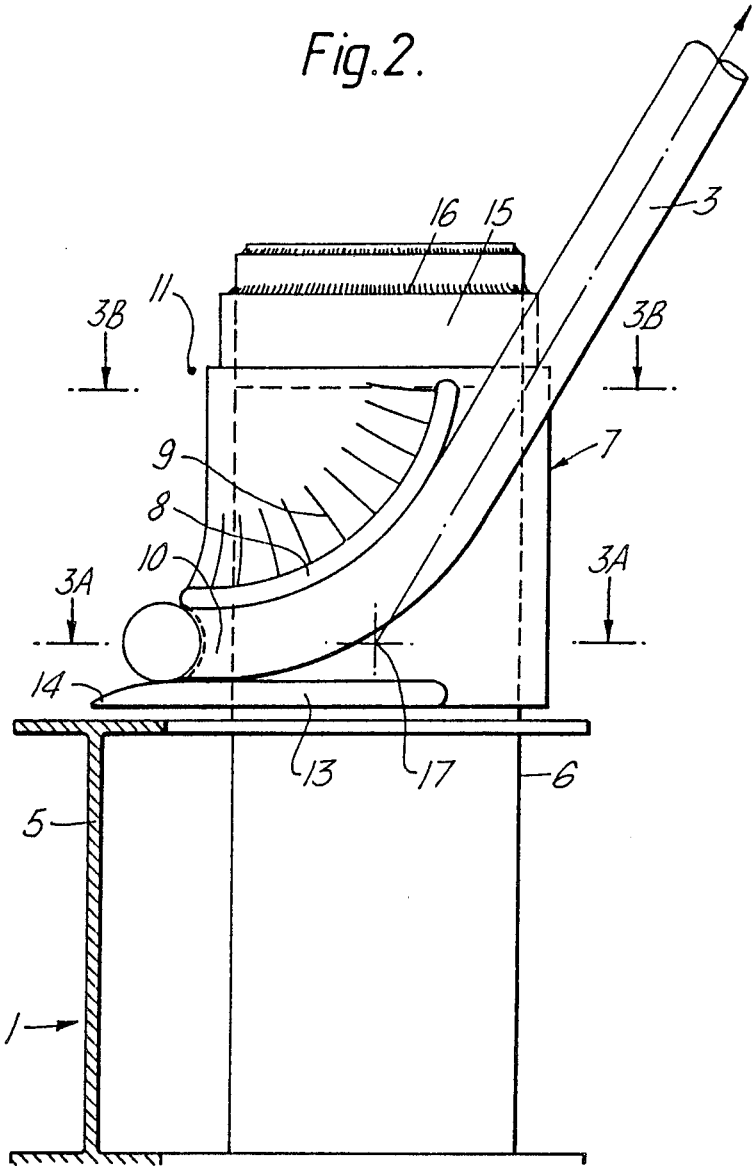
FIG. 2 is a side view of a lifting attachment, being a first embodiment of the present invention.

The attachment is seen better in FIG. 2 where an upper girder structure 5 of the module 1 is seen and a post 6 of the attachment is massively welded into the corner of the structure. In the present case the post (which must have a cylindrical outer surface) is a tube. Rotatably borne on the tube above the upper level of the girder 5 of the module is a generally cylindrical sleeve 7. It is a single casting of steel. It is rotatable about the post, contacting the post internally by means of lands at each of its axial ends and being relieved in between. This contact at ascertained positions allows for exact balances of the loads arising since it then does not matter if the post is not precisely straight or smooth.

The outer surface of the sleeve is although generally cylindrical not completely so. In particular an upper flange 8 projects from its surface being reinforced above by a buttress-like thickening 9 and there being below it a thickening 10 in the wall of the sleeve 7, which progresses to reach a maximum below the lowermost point of the flange. This thickening 10 is of a slightly channel profile, this channel following the line of the flange 8, so that it conforms to and receives at least part of the generally cylindrical outer surface of a cable laid sling.

Figure 3:
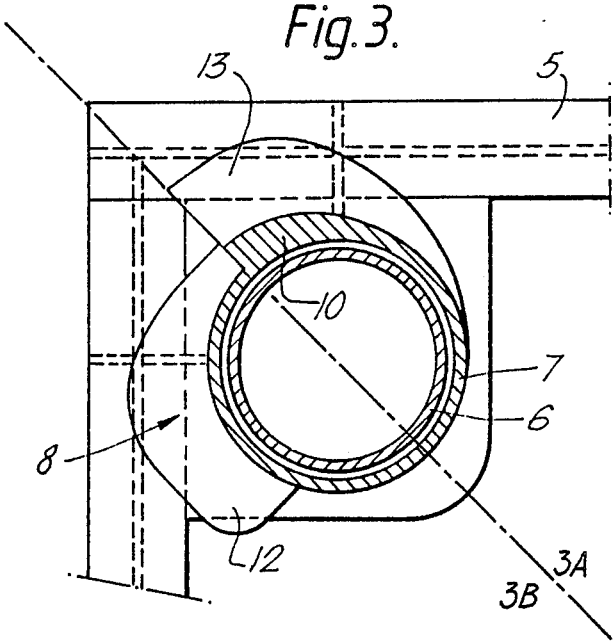
FIG 3 is a sectional view of the first embodiment, showing at its upper right diagonal half a section on the plane 3A in FIG. 2 and at its lower left diagonal half a section on the plane 3B.

The upper flange 8 is curved as seen in developed side-view (FIG. 2). This curve is preferably (in the same view) an arc of a circle and this may be centered, at 11, outside the wall of the sleeve 7, where the center 11 is approximately vertically above the lowest and radially innermost portion of the thickening 10. It can be seen that as progressively greater vertical loads are placed on the sling it will progressively contact a greater length of the flange 8 thereby being guided progressively and smoothly, without bending or undue concentration of stress, over the increasing load-bearing surface namely the undersurface of the flange 8, the load being transmitted through this and the buttressing 9 into the sleeve and hence to the post. As can be seen from FIG. 3 the upper flange 8 is comparatively narrow at its lowermost point widening to rather wider wings 12 as it reaches its uppermost levels.

The geometry of the flange is also such that the line of action of the sling intersects with the axis of the post as low as possible—see 17, FIG. 2—thereby minimizing moment on the post.

There is also a generally planar lower flange 13 which is of maximum width adjacent to the lowermost point of the channel on the thickening 10, and is downwardly tapered at 14. The second flange 13 is radially projecting and extends circumferentially at least partly around the post. It has an upper face spaced apart from and opposing the retaining upper flange 8. This acts to assist in guiding and lifting the bight of the sling into the channel 10 and under the flange 8. The continuation of the lower flange around the sleeve provides external stiffening (as does also the provision of the upper flange 8, but that is not the primary function of the latter).

To retain the sleeve on the post and transmit the vertical component of the lifting load to the post there is a stop ring 14 which is a cylindrical part welded at 16 around its upper circumference. It can be seen that the sleeve is free to be rotated about the vertical so as to be facing the correct direction for an expected lift, and the sling is self-adjusting on it according to the load experienced.

The sleeve is re-usable by being removed from the post. In the embodiment described this is done by cutting through the post between the bottom of the sleeve and the top of the girder structure 5, the upper part of the post then being discarded, or by cutting out the weld 16 and removing the ring 15 in which case the sleeve is lifted off and the post is left in position. An alternative mode of making the sleeve re-usable is mechanically to secure a ring or other stop to the post. An example is a split retaining ring housed in an endless groove in the post and held in position by a band clamp.

Figure 4:
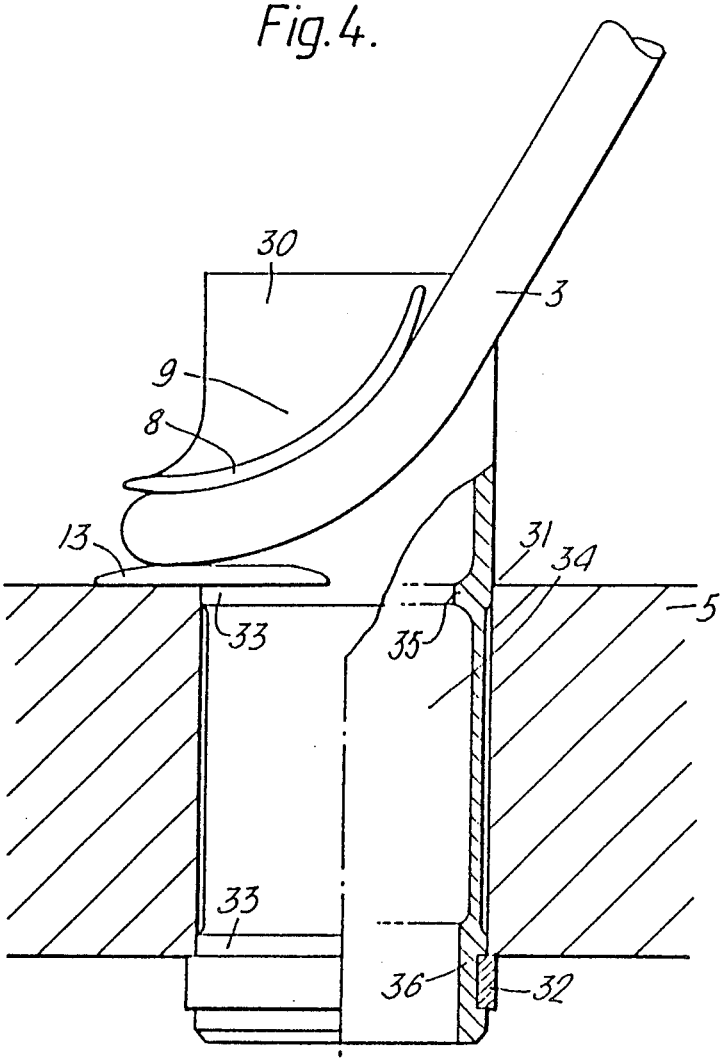
FIG. 4 is a side view of a lifting attachment, being a second embodiment of the present invention. The lower right hand part of FIG. 4 is a section.

FIG. 4 shows a second embodiment of a lifting attachment according to the invention. This has an upper flange 8 similar to that of the first embodiment, but instead of a cylindrical sleeve carried on a post has a tubular cylindrical member 30 passing through a hole 31 in the deck of the module 5. The cylindrical member is retained in the hole from above by a guiding lower flange 13 (which is the same as in the first embodiment), and from below by a shear ring 32 made up of sections bolted onto the member 30 and which transmits vertical load from the cylindrical member to the module during lifting by abutting against the undersurface of the deck. Contact between the cylindrical member 30 and the module 5 is made at lands 33. There are internal thickenings 35, 36 opposite the lands. The cylinder also has, as before, thickened portions forming a buttress 9 above flange 8 and a shaped cable-receiving channel between flanges 8 and 13.

In a preferred version, the central cavity 34 of the member 30 is filled with a grout or some other rigid filler, which serves to distribute and reduce local stresses in the walls of the cylindrical member 30, in particular where it makes contact with the cable 3 and module 5.

In use the attachment may be rotated in the hole 31 to face in the desired direction. This embodiment has the advantage that nothing is left projecting above the surface of the module after removal of the attachment which is achieved after removal of the shear ring 32.

A further advantage of these constructions is that they can be pre-tested to a proof load to assure that the lifting device can withstand a certain loading. The testing can be applied to a run of lifting attachments alone, or to specific combinations of sleeves and posts or posts and holes.

Figure 5:
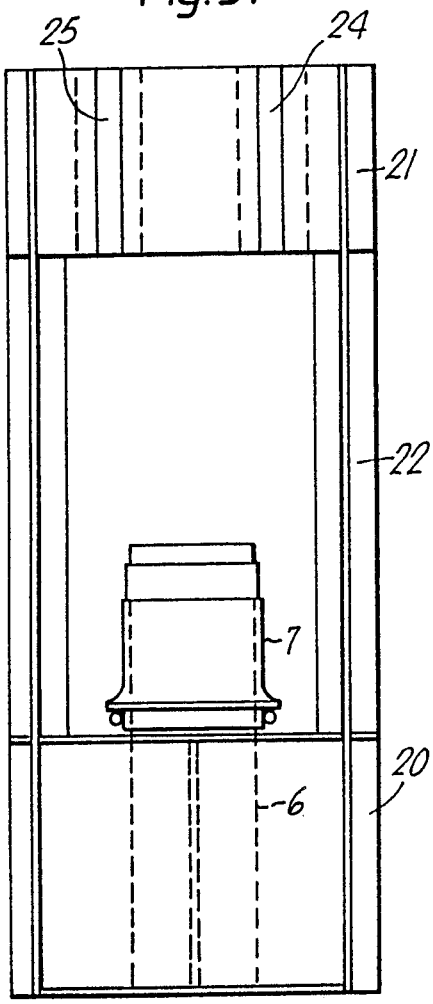
FIG. 5 is a front view of a test rig.
Figure 6:
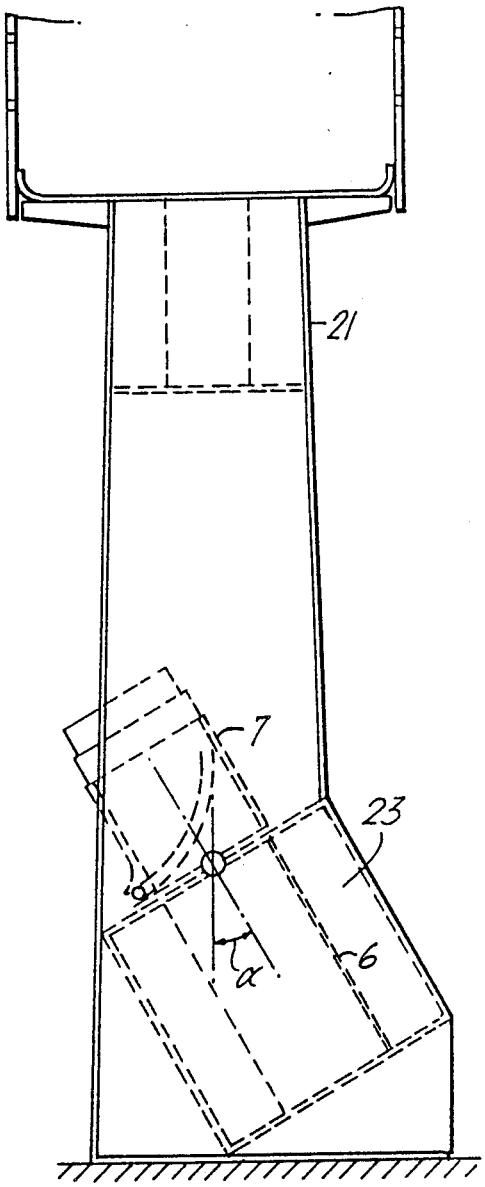
FIG. 6 is a side-view of the test rig.

The test rig is seen in FIGS. 5 and 6, used on the lifting attachment of the first embodiment. A massive base 20 and massive head 21 is linked by equally massive girders 22 and the head is generally vertically above the base.

A box girder 23 in the base is fixedly mounted at a predetermined angle, alpha simulating actual and design loading conditions, to the vertical and into it is secured the post 6 of an assembly under test with a sleeve 7 and a stop above it just as if the box girder 23 were the corner of the module 1. Above the head 21 are housed two or more cable jacks—for example devices known as strand jacks which are used in heavy lift applications. A run of cable is taken from one jack down through aperture 24 round the sleeve under its upper flange and back up through aperture 25 to another jack. By summation of the load exerted by the jacks the load to which the assembly is being subjected may be measured. The angle alpha may be fixed at that which is the maximum design angle for a sling in actual use namely 30° (giving a 60° angle of lift on the sling relative to the horizontal).

A standard range of sleeves may be provided for posts of a range of diameters e.g. 12, 18, 24, 35, 48 inches; and the profile of the channel in the thickening 10 may be suitable for a range of cable diameters e.g. 6, 8, 10, 12 inches.

I claim:

1. A lifting attachment for lifting a heavy load with a lifting sling, comprising a generally cylindrical member having upper and lower ends, to be rotatably fitted in a hole in the load with said upper end towards an intended lifting direction, said member being configured to withstand longitudinal and lateral stresses, removable means, to be fitted to said member below said hole, for preventing, while so fitted, upward escape of said member from said hole while permitting rotation of said member relative to said hole, a radially projecting retaining flange for retaining the lifting sling, said retaining flange extending circumferentially at least partly around said cylindrical member, and said retaining flange having portions curving upwardly from a lowermost portion of said retaining flange, and a radially projecting lower flange extending circumferentially at least partly around said cylindrical member, said lower flange having an upper face spaced apart from and opposing said retaining flange.

2. A lifting attachment according to claim 1, wherein said cylindrical member has a thickened portion in the form of a buttress above at least part of said retaining flange.

3. A lifting attachment according to claim 1, wherein said upwardly curving portions of said retaining flange project further radially than said lowermost portion.

4. A lifting attachment according to claim 3, wherein said lower flange has a maximum radial width at a position opposing said lowermost portion of said retaining flange.

5. A lifting attachment according to claim 1, wherein said retaining flange is substantially symmetrical about a plane containing the axis of said cylindrical member.

6. A lifting attachment according to claim 5, wherein said lowermost portion of said retaining flange projects radially, in said plane, substantially normal to said axis.

7. A lifting attachment according to claim 5, wherein a parallel projection of said retaining flange onto the plane containing the axis of said cylindrical member forms a substantially circular arc.

8. A lifting attachment according to claim 1, wherein said lower flange is substantially flat.

9. A lifting attachment according to claim 1, wherein said cylindrical member has an outwardly thickened portion between said retaining flange and said lower flange, said thickened portion being shaped to provide a channel for the lifting sling.

10. A lifting attachment according to claim 1, wherein said lower flange has a maximum radial width at a position opposing said lowermost portion of said retaining flange.

11. A lifting attachment according to claim 1, wherein said cylindrical member and said retaining flange are parts of a one piece casting.

12. A lifting attachment according to claim 1, wherein said means for preventing comprises a shear ring including a plurality of sections mounted to said cylindrical member below said hole to prevent upward movement of said cylindrical member through said hole.

13. A lifting attachment according to claim 1 wherein said cylindrical member is generally tubular.

14. A lifting attachment according to claim 1 wherein said cylindrical member is formed with land portions separated by a relieved portion so as to contact the load at ascertained positions.

15. A heavy load adapted for lifting by lifting slings, said heavy load being provided with a plurality of axially vertical cylindrical holes, said cylindrical holes containing the lower parts of respective axially vertical closely fitting cylindrical posts, said cylindrical posts being configured to withstand longitudinal and latter stresses, said cylindrical posts being formed with land portions separated by a respective relieved portion so as to contact regions within said holes at ascertained positions, said cylindrical posts having removable mechanical stops below the holes for preventing upward axial movement but permitting rotation of said cylindrical posts relative to said cylindrical holes, wherein upper parts of said cylindrical posts above respective ones of said cylindrical holes are provided with radially projecting flanges for retaining said lifting slings, each of said flanges extending circumferentially at least partly around its respective cylindrical post and having portions curving upwardly from a lowermost portion of that flange.

16. A heavy load according to claim 15 wherein said cylindrical posts are generally tubular.

* * * * *